United States Patent [19]

Marzonie et al.

[11] 4,025,754

[45] May 24, 1977

[54] ELECTRICALLY HEATED DRYER

[75] Inventors: James M. Marzonie, Hancock; Karl Jautakis, Sawyer, both of Mich.

[73] Assignee: Whirlpool Corporation, Bentob Harbor, Mich.

[22] Filed: June 16, 1975

[21] Appl. No.: 587,436

[52] U.S. Cl. ..... 219/400; 34/132; 219/368; 219/374; 219/381; 338/58; 338/206; 338/283

[51] Int. Cl.² ..... F26B 11/00; H05B 3/02; H01C 3/10; F24H 3/04

[58] Field of Search ..... 219/374–376, 219/381, 382, 369–371, 366–368, 552, 532, 400, 307; 338/316, 317, 318, 53, 57, 58, 279–282, 283–285, 287–291, 206; 34/132, 133

[56] References Cited

UNITED STATES PATENTS

| | | | |
|---|---|---|---|
| 3,239,947 | 3/1966 | Kenreich | 219/400 UX |
| 3,244,860 | 4/1966 | Lindley | 219/374 |
| 3,651,304 | 3/1972 | Fedor | 219/552 X |
| 3,790,751 | 2/1974 | Kuhn | 219/400 X |
| 3,798,417 | 3/1974 | Bittner | 219/375 X |
| 3,835,435 | 9/1974 | Seel | 219/375 |
| 3,852,568 | 12/1974 | Clement | 219/375 |
| 3,860,789 | 1/1975 | Maake | 219/375 X |

*Primary Examiner*—A. Bartis

*Attorney, Agent, or Firm*—Wegner, Stellman, McCord, Wiles & Wood

[57] ABSTRACT

An electrically heated dryer for articles comprises a drying container and an air duct leading thereto for directing air in a stream through the duct and into the container. An electric resistance heating element is provided in the duct and comprises an expanded resistance metal sheet of separated strands and connecting bridges with the strands at an angle to the sheet and generally parallel to each other. The element is serpentively arranged in the duct in successive substantially planar reaches spanning the duct with the strand surfaces of the upstream reaches arranged substantially parallel to the direction of air flow for streamline wiping action thereof by the air stream. A planar reach downstream of said upstream reaches is arranged with its strand surfaces substantially non-parallel to the direction of air stream flow to aid in mixing the heated air prior to delivery into the container.

3 Claims, 6 Drawing Figures

ELECTRICALLY HEATED DRYER

BACKGROUND OF THE INVENTION

This invention relates to an electrically heated dryer for articles such as clothes which are held in a container during the drying with an electric resistance heating element being provided for heating air flowing to the container and with the element comprising a resistance metal sheet of separated strands at an angle to the sheet and generally parallel to each other and generally parallel to the air flow stream which thereby is caused to flow over the surfaces of the strands in an essentially wiping action.

The prior art discloses electric resistance heating elements for heating air before it contacts the articles in order to promote the drying. This of course is basic structure in an electrically heated dryer. Three patents, U.S. Pat. Nos. 3,651,304; 3,798,417; and 3,860,789 disclose electric heating elements for heating a moving air stream in which the elements comprise thin strips of apertured metal foil with the moving air stream flowing through the apertures in contact with the foil to be heated thereby. Also, U.S. Pat. No. 2,875,310 discloses an electrical-resistance structure in which the individual elements each have a thin leading edge and curved surfaces along which the air flow through the electrical-resistance structure forms a tangential path. None of these nor any other reference of which applicants are aware, however, disclose the dryer of this invention including the expanded metal heating element having separated strands arranged generally parallel to each other and generally parallel to the air flow so that each strand forces the air flow edgewise so that the air contacts the heating element in a wiping action over the surfaces of the stands for transferring heat from the element to the flowing air and thereby to the dryer.

SUMMARY OF THE INVENTION

The invention essentially is directed to an electrically heated dryer which is similar to prior dryers of this type except that the heating element comprises an expanded resistance metal sheet having the usual strands interconnected by bridges and otherwise separated from each other to provide openings through which the drying air flows for heating thereof. In this invention the strands are angled to the sheet as is customary in expanded metal generally but thse strands are not only essentially parallel to each other but also parallel to the air flow so that as the air flows through the openings separating adjacent strands it wipes across the surfaces of the strands for efficient heat transfer from the element to the air without substantial loss of speed of air flow as the edgewise presentation of the strands to the air avoids excessive turbulence which would tend to interfere with the rate of air flow.

This edgewise arranging of the separated strands aids convection heating of the air while at the same time reducing radiant heat transfer and thereby heat losses to the environment exteriorly of the air flow stream. It also reduces resistance to air flow and therefore increases the speed of transferring heat from the heating element to the interior of the container that holds the articles during drying. The invention also maintains a somewhat lower temperature in the heating element because the heat is transferred rapidly from the element to the flowing air.

DESCRIPTION OF THE PREFERRED EMBODIMENT

Figure 1:
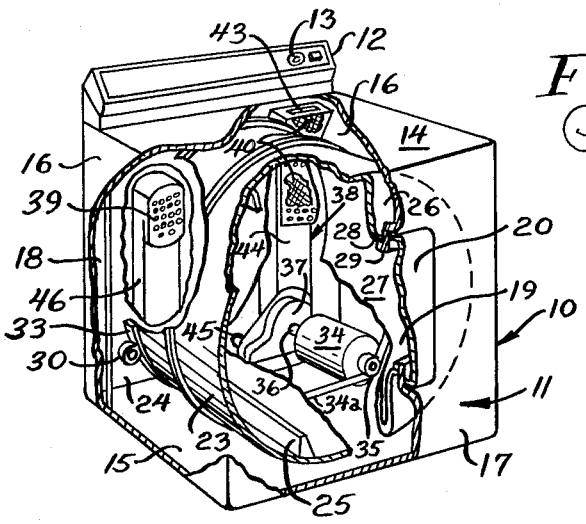
FIG. 1 is a perspective view partially in section and partially broken away of a clothes dryer embodying the invention.

In the embodiment illustrated in the drawings the clothes dryer apparatus 10 comprises an enclosing cabinet 11 having a control console of the usual type that houses a control device settable by a control knob 13 for regulating the drying operation of the dryer 10, as for example either automatic or timed drying cycles.

The cabinet 11 comprises a generally horizontal top panel 14, a horizontal bottom panel 15, a pair of vertical side panels 16, a vertical front panel 17 and a vertical rear panel 18. The cabinet also includes an access opening 19 in the front panel 17 having a closure door 20 of the customary type cooperating with the opening for loading and unloading the dryer 10.

The dryer 10 further includes a drying container for tumbling the clothes during the drying thereof in the form of a rotatable drum 23 housed within the cabinet 11 and extending axially from approximately the front panel 17 to a bulkhead 24 that is spaced forwardly of the rear panel 18. To develop tumbling action in the drum 23 of the clothes being dried therein there are provided a plurality of circumferentially-spaced baffles 25 extending generally radially of the inner surface of the drum 23. The drum includes a radially inwardly extending front closure wall 26 having an access opening 27 therein formed by an outturned flange 28 that extends essentially axially. This flange 28 provides a forward-extending bearing annulus which overlies and is suitably journaled on the complemental flange 29 of the cabinet 11.

The drum 23 is supported at the rear by a pair of support rollers 30 of which only one is shown in FIG. 1. These are horizontally aligned on opposite sides of the drum and are mounted on the bulkhead 24. A raceway or centrifugal groove 33 is provided in the drum to serve as a track for the supporting rollers 30.

In order to rotate the drum 23 there is provided a motor 34 mounted on the bottom panel 15 at a rear corner of the cabinet. The drum is driven by a drive belt **34*a* that extends around the periphery of and in frictional engagement with the drum and around a motor driven pulley 35. The pulley 35 is mounted on the front end of the horizontal motor shaft 36 while the other or rear end of this shaft drives a blower 37 arranged to circulate air through the drum 23 in the customary manner. This blower 37 is included in a warm air system 38 that is located between the rear panel 18 and the bulkhead 24**.

The bulkhead 24 serves to enclose the open ended rear portion of the drum 23 and provides a fixed rear wall in which is located a pair of spaced openings comprising an air inlet 39 and an air outlet 40.

The blower 37 draws moisture laden air from the interior of the drum 23 through the outlet 40, through a removable lint screen 43 and an air duct 44 downwardly to the blower 37 and out of the cabinet 11 through an exhaust duct 45.

Air exhausted in this manner from the drum 23 is replaced by ambient air entering the warm air system 38 by way of an intake opening (not shown) in the rear panel 18. This fresh air is drawn through a fresh air duct 46 where it is heated and then flows into the drum 23 from the air outlet 39. The warm air system 38 thus circulates a stream of warm air through the drum 23 subjecting clothes placed therein to a drying environment during the tumbling caused by the rotation of the drum and the baffles 25 to remove moisture from the clothes.

Figure 5:
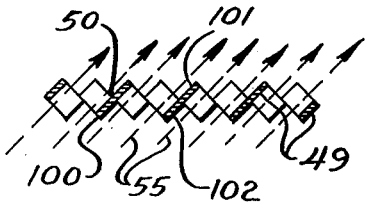
FIG. 5 is a fragmentary sectional view taken substantially along line 5—5 of enlarged FIG. 4.

The fresh air duct 46 and the heating system therefore of this invention is illustrated in the enlarged views of FIGS. 2–5. As is illustrated there the duct 46 comprises an elongated heater box in which a resistance element 47 substantially spans the internal dimensions of the duct. This resistance element 47 comprises a pervious sheet 48 of resistance metal which may be, for example, Inconel alloy 601 which is 60.5 percent nickel, 14.1 percent iron, 23 percent chromium, 1.35 percent aluminum, 0.05 percent carbon, 0.5 percent manganese, 0.007 percent sulfur, 0.25 percent silicon, and 0.25 percent copper. The sheet 48 is expanded in that it comprises strands 49 interconnected by bridges 50 with laterally adjacent strands separated by fluid flow openings 53 as illustrated in enlarged detail in FIGS. 4 and 5. Each strand 49 and the connected bridges 50 define surfaces disposed generally at an angle to the sheet 48 as illustrated in FIG. 5 with the planes of adjacent strand surface portions being essentially parallel to each other.

Insulating means comprising spaced lateral posts 54 are provided for mounting the resistance element 47 within the duct 46 in a plurality of substantially parallel reaches 56 spaced from each other across the duct with electric current being supplied to the element by end terminal connections 57. The strands 49 of the element 47 define parallel surfaces adjacent to one another, and in each reach 56 these surfaces are substantially parallel to the air flow stream 55. Thus the air flow 55 has a wiping action over the opposite surfaces of each of the strands 49 and the connecting bridges 50. This arrangement of the strands is achieved by mounting the resistance element within the duct 46 so that the angle formed by the surfaces of each strand 49 and bridge 50 with respect to the plane of each reach 56 is substantially equal to the angle between the direction 55 of air flow through the duct 46 and the plane of each reach 56. In the illustrated embodiment the angle of the reaches 56 to the air flow stream 55 and the angle of each strand 49 and bridge 50 to the sheet 48 are each substantially 45°.

For drying clothes in the dryer electrical power is applied to the heater terminals 57 and the expanded metal heater element 47 becomes hot. Ambient air is drawn through the duct 46 in an air flow pattern generally along the direction indicated by the arrows 55 (see FIGS. 2 and 5) and into the dryer drum. Most of the ambient air will be drawn past the reaches 56 of the resistance element sheet 48 through the flow openings 53, and as this air passes the substantially parallel strands 49 and bridges 50 heat transfer through conduction takes place between the heating element reaches and the air. Because the air flow is substantially parallel to the planes formed by the strands and bridges only the leading edge 100 of each strand and bridge will generally present an obstruction to the flow of air and the total obstruction to air flow past the heater will be low. For this reason, turbulence in the area of the heater will be minimized and the rate of air flow maximized. Opposite surfaces 101 and 102 of the various strands and bridges will be exposed, to a generally maximum extent, to the stream of air as shown in FIG. 5 so that efficient conduction of heat from the surfaces 101 and 102 of the heating element will be possible. The moving air efficiently "wipes" heat from the exposed surfaces and carries that heat into the dryer drum. In this way, both the overall temperature of the heating element and undesirable radiant heat transfer from the heating element are minimized.

Figure 2:
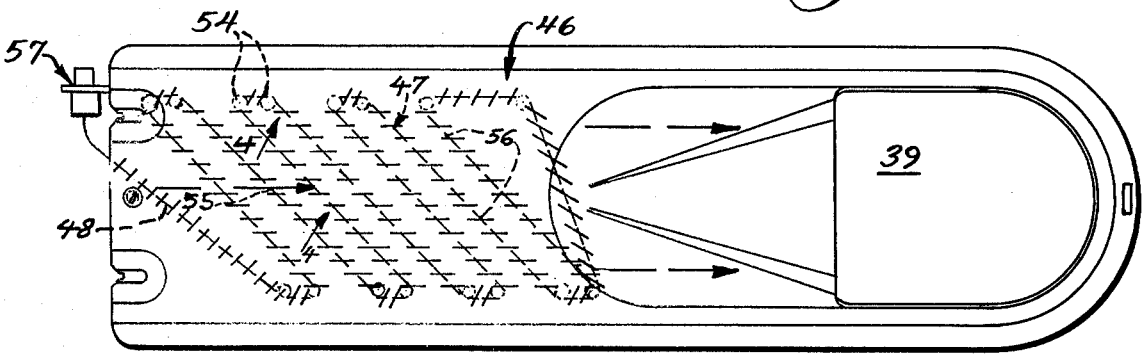
FIG. 2 is an enlarged detail side elevational view of the air duct of the dryer of FIG. 1.
Figure 3:
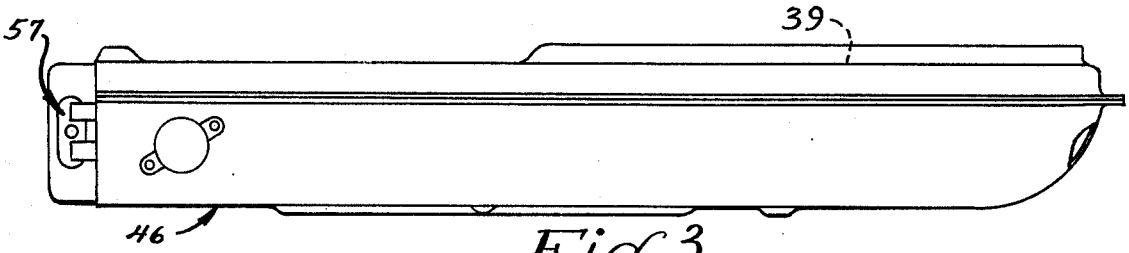
FIG. 3 is an edge elevational view of the duct of FIG. 2.
Figure 4:
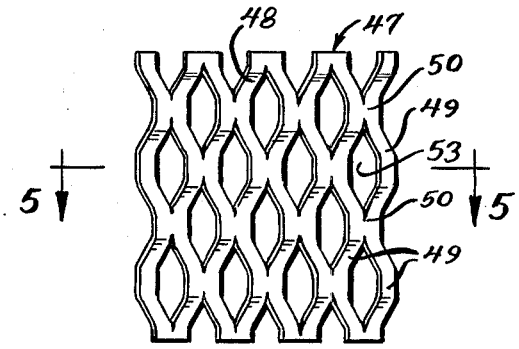
FIG. 4 is an enlarged elevational view of a portion of the expanded metal heating element taken along line 4—4 of FIG. 2.
Figure 6:
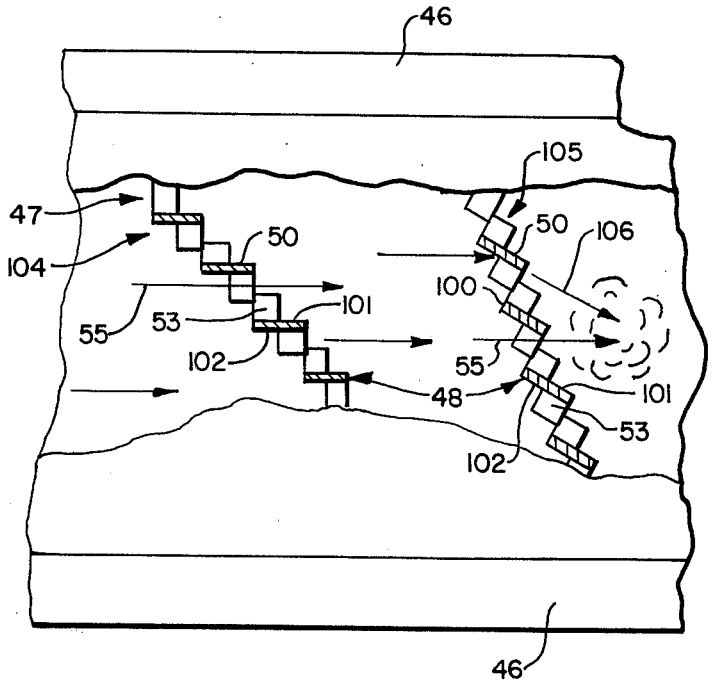
FIG. 6 is a fragmentary longitudinal section illustrating the arrangement of the heating element within the duct.

As shown in FIG. 2, and more clearly shown in FIG. 6, the upstream reaches commencing with the inlet to duct 46 extend across the duct at an angle of approximately 45°. Thus, as the angle of each strand 49 and bridge 50 in the respective reaches is 45° to the flat plane thereof, the air flow through the duct 46 is substantially parallel to the longitudinal extent thereof and the opposite surfaces 101 and 102 of the various strands and bridges are suitably disposed so as to have the drying air flow parallel therealong. This relationship is illustrated in FIG. 6 by the parallel relationship of the air flow arrow 55 to the surfaces 101 and 102 in the upstream reach 104.

However, as the last reach 105 extends at a greater angle to the longitudinal extent of the duct than the upstream reaches 104, the air impinging on the surface 102 of the strands and bridges thereof is deflected so as to flow from the last reach 105 in the direction of the arrow 106. Resultingly, the deflected air tends to mix somewhat with air flowing through the last reach 105 in the general longitudinal direction of arrow 55 to provide an improved heated air delivery from the heater element 47.

Having described our invention as related to the embodiment shown in the accompanying drawings, it is our intention that the invention be not limited by any of the details of description, unless otherwise specified, but rather be construed broadly within its spirit and scope as set out in the appended claims.

The embodiment of the invention in which an exclusive property or privilege is claimed is defined as follows:

1. In a dryer having a container for removably containing articles to be dried, a duct having an outlet communicating with said container, and an inlet, and means for delivering an air stream from said inlet through said duct to said outlet, improved means for heating the air in said stream comprising:

an electric resistance heating element in said duct comprising an expanded resistance metal sheet defining separated strands and connecting bridges, the strands defining parallel surfaces extending at a preselected angle to said sheet; and means for mounting said element in said duct serpentinely with said sheet spanning said duct in successive substantially planar reaches with said strand surfaces of the upstream reaches commencing from said inlet being substantially parallel to the direction of flow of said air stream from said inlet to said outlet for essentially streamline wiping action of substantially the entire area of said surfaces by said air stream, said sheet further including a substantially planar reach downstream of said upstream reaches spanning said duct with said strand surfaces thereof being substantially non-parallel to said direction of flow of said air stream.

2. The dryer structure of claim 1 wherein the strand surfaces of each of the reaches is at an angle of approximately 45° to the planar extent thereof.

3. The dryer structure of claim 1 wherein said upstream reaches extend at a 45° angle to the longitudinal extent of the duct and said downstream reach extends at a different angle.

* * * * *